US006036110A

United States Patent [19]

Kanatzar et al.

[11] Patent Number: 6,036,110

[45] Date of Patent: Mar. 14, 2000

[54] BATHING SOLUTION DISPENSING MECHANISM WITH CADDY AND DUAL VANITY MIRROR FOR A SHOWER

[76] Inventors: Jeff A. Kanatzar; Teri Kanatzar, both of 13835 S. Darnell, #605, Olathe, Kans. 66062

[21] Appl. No.: 09/073,896

[22] Filed: May 6, 1998

[51] Int. Cl.[7] ..... B05B 7/00

[52] U.S. Cl. ..... 239/317

[58] Field of Search ..... 239/310, 317, 239/318; 251/205, 208; 222/180

[56] References Cited

U.S. PATENT DOCUMENTS

| | | | |
|---|---|---|---|
| 3,194,444 | 7/1965 | Hubert | 239/317 X |
| 3,207,445 | 9/1965 | Court et al. | 239/318 |
| 4,121,773 | 10/1978 | Headen et al. | 239/317 |
| 4,218,013 | 8/1980 | Davison | 239/74 |
| 4,294,280 | 10/1981 | Tom | 239/310 X |
| 4,358,056 | 11/1982 | Greenhut et al. | 222/454 |
| 4,432,105 | 2/1984 | Pitroda | 239/318 X |
| 4,463,462 | 8/1984 | Greenhut | 4/605 |
| 4,836,668 | 6/1989 | Christianson | 350/588 |
| 4,901,765 | 2/1990 | Poe | 137/893 |
| 5,058,271 | 10/1991 | Jursich et al. | 30/123 |
| 5,333,789 | 8/1994 | Garneys | 239/318 |
| 5,339,469 | 8/1994 | Gilles | 4/601 |

*Primary Examiner*—Andres Kashnikow
*Assistant Examiner*—Sean P. O'Hanlon
*Attorney, Agent, or Firm*—Henderson & Sturm LLP

[57] ABSTRACT

A shower caddy incorporating a moisturizing/bathing solution dispensing apparatus including an in line diverter valve for diverting the flow of shower water through a mixing chamber and back to the shower head by selectively positioning a diverter knob. A shower caddy extends downward from the diverter valve assembly and has compartments for storing a number of bathing items such as sponges, soaps, and other bathing items, shampoos and conditioners. A pair of fog free mirrors extend from a bendable arm and are articulateable in a manner such that a person rinsing their hair can view the image in one of the mirrors by looking at the second mirror to insure that the conditioner and shampoo are properly rinsed from the hair.

1 Claim, 1 Drawing Sheet

BATHING SOLUTION DISPENSING MECHANISM WITH CADDY AND DUAL VANITY MIRROR FOR A SHOWER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of bathing accessories, and more particularly to a bathing solution dispenser with a caddy and vanity mirrors for a shower.

2. Description of Related Art

As can be seen by reference to the following U.S. Pat. Nos. 4,218,013; 4,358,056; 4,432,105; 4,463,462; 4,901,765; and 5,339,469, the prior art is replete with myriad and diverse bathing accessories.

While all of the aforementioned prior art constructions are more than adequate for the basic purpose and function for which they have been specifically designed, they are uniformly deficient with respect to their failure to provide a simple, efficient, and practical bathing solution dispenser for a shower.

As a consequence of the foregoing situation, there has existed a longstanding need for a new and improved bathing solution dispenser and the provision of such a construction is a stated objective of the present invention.

BRIEF SUMMARY OF THE INVENTION

Briefly stated, the present invention provides a shower caddy incorporating a moisturizing/bathing solution dispensing apparatus including an in line diverter valve for diverting the flow of shower water through a mixing chamber and back to the shower head by selectively positioning a diverter knob. A shower caddy extends downward from the diverter valve assembly and has compartments for storing a number of bathing items such as sponges, soaps, and other bathing items, shampoos and conditioners. A pair of fog free mirrors extend from a bendable arm and are articulateable in a manner such that a person rinsing their hair can view the image in one of the mirrors by looking at the second mirror to insure that the conditioner and shampoo are properly rinsed from the hair.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
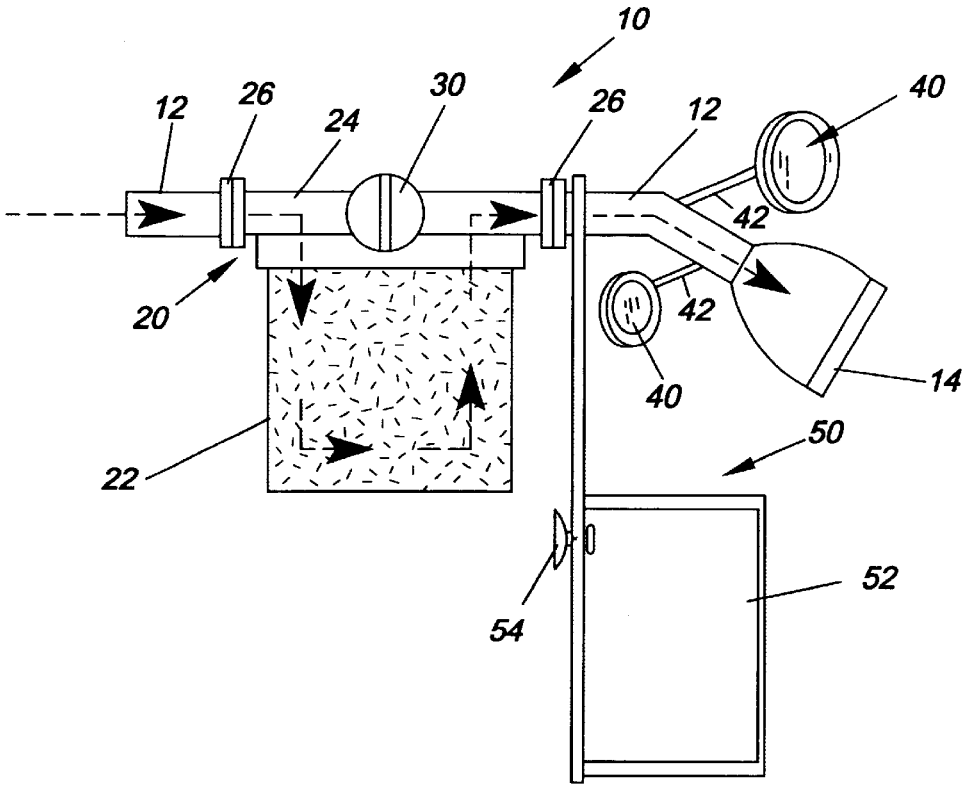
FIG. 1 is a side elevational view of the bathing solution dispenser of the present invention.
Figure 2:
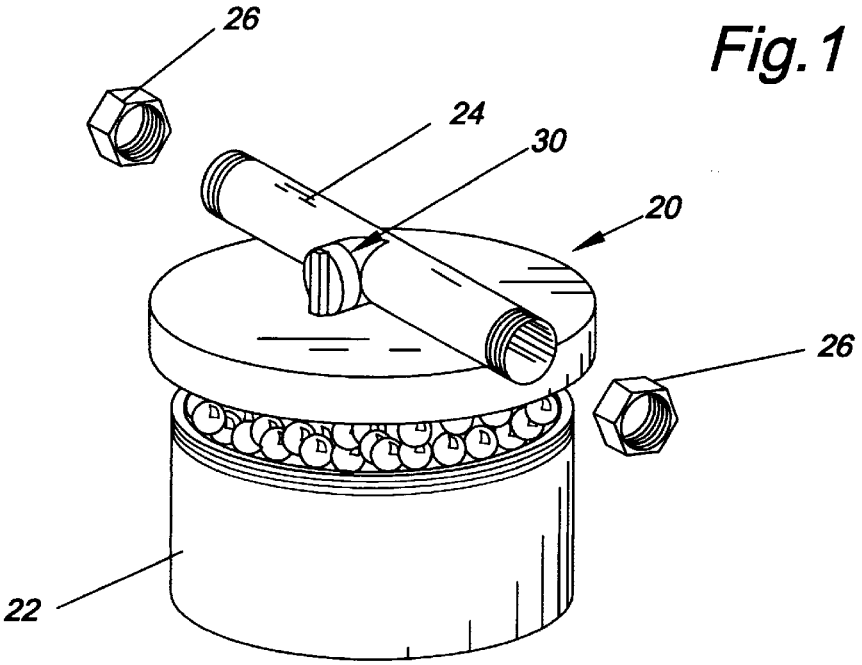
FIG. 2 is an exploded perspective view illustrating the solution container being attached to the connection lid assembly.

As can be seen by reference to the drawings, and in particularly to FIG. 1, the bathing solution dispenser that forms the basis of the present invention is designated generally by the reference number 10. The dispenser 10 consists of an application device that connects to existing piping 12 supplying a shower head 14 to release a preselected solution, such as a liquid soap or skin moisturizer, while showering. Attached to the dispenser 10 by bendable arms 42 are dual mirrors 40. A shower neck tote 50 is attached to the piping 12 leading to the shower head 14, and includes an open basket 52 and a suction cup 54. The dispenser 10 incorporates convenient shower accessories with the added benefit of dispensing solutions through the bather's shower water.

The dispenser 10 incorporates a design similar to a standard shower head with a separate threaded connector lid 20 and attached container 22. The connector lid 20 includes a nipple 24 attached by nuts 26 to the existing piping 12. A flow diverter knob 30 is secured at the midpoint of the nipple 24 to allow the user to run water directly through to the shower head 14, or to divert the water through the container 22 as illustrated in FIG. 1

In use, a user substitutes the dispenser 10 of the present invention for the standard shower head. Once in place, the user unscrews the moisturizer container 22 from its lid mounting 20 and fills the container 22 with his choice of solutions, such as moisturizing beads, sticks, lotion, etc. Once filled, the user once again threads the container 22 back onto the lid mounting 20 and uses the shower in a normal fashion. Should the user wish to release solutions into the shower water, they would adjust the flow diverter knob 30 to the "closed" position, causing the water to flow through container 22 and out through the shower head 14. Should the user wish to bathe with standard water only, they simply adjust the flow diverter knob 30 to the "open" position, causing water to flow directly through the nipple 24 and out through the shower head 14. The user may also place commonly used bathing items such as shampoo, soap, etc. inside the basket 52 of the neck mounted tote 50 for convenience. Additionally, the user may position the shaving/vanity mirrors 40 by grasping the mirrors 40 and bending the segmented arms 42 so that they conform to the desired angles.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. A bathing solution dispensing mechanism for a shower having a water supply pipe and a shower head, the dispensing mechanism consisting of;

a nipple attached in fluid communication with the water supply pipe upstream of the shower head, and attached in fluid communication with a container through a container lid wherein the container is threadably attached to the container lid, and the container holds a supply of moisturizing beads soluble in water;

a flow diverter valve disposed in the nipple and being selectively positionable between a first position allowing full flow of water directly through the nipple to the shower head, and a second position allowing full flow of water through the container before flowing to the shower head whereby material in the container is selectively discharged from the shower head;

a tote caddy including a basket portion attached to and extending down from the water supply pipe; and a pair of mirrors, each being attached by a segmented arm to the water supply pipe, and each being independently selectively positionable with respect to each other.

* * * * *